United States Patent [19]

Arneth et al.

[11] 4,073,266

[45] Feb. 14, 1978

[54] APPARATUS FOR DEVELOPING A LATENT ELECTROSTATIC IMAGE ON AN ELECTROPHOTOGRAPHIC COPYING MATERIAL

[75] Inventors: Reinhold Arneth, Budenheim; Rudi Schwandt, Wiesbaden-Erbenheim, both of Germany

[73] Assignee: Hoechst Aktiengesellschaft, Frankfurt am Main, Germany

[21] Appl. No.: 658,504

[22] Filed: Feb. 17, 1976

[30] Foreign Application Priority Data

Feb. 20, 1975 Germany ..... 2507221

[51] Int. Cl.[2] ..... G03G 15/10

[52] U.S. Cl. ..... 118/647; 118/652; 118/661; 96/1 SD; 355/10

[58] Field of Search ..... 118/DIG. 23, 637, 110, 118/644, 651, 652, 661; 355/10; 427/17; 96/1 SD

[56] References Cited

U.S. PATENT DOCUMENTS

| | | | |
|---|---|---|---|
| 3,592,675 | 7/1971 | Cheng | 118/637 |
| 3,689,147 | 9/1972 | Suzuki | 355/10 |
| 3,905,331 | 9/1975 | Kimura et al. | 118/DIG. 23 |
| 3,921,579 | 11/1975 | Wright | 118/DIG. 23 |

FOREIGN PATENT DOCUMENTS

| | | |
|---|---|---|
| 7,418,392 | 5/1974 | Germany. |

*Primary Examiner*—Henry S. Jaudon
*Attorney, Agent, or Firm*—Richard L. Schwaab

[57] ABSTRACT

A process and apparatus for developing a latent electrostatic image on an electrophotographic copying material by means of a toner dispersion. An infeed roller applies the toner dispersion to the copying material, and, downstream thereof, a distribution roller acts on the surface of the copying material. To solve the problem of reproducing fine white indicia, such as thin white lines, on a black background, a voltage, having the same polarity as the surface charge of the latent electrostatic image on the copying material, is applied to the distribution roller. Squeegee rollers downstream of the distribution roller effect removal of unused toner. Toner, which adheres to the distribution roller during application of voltage to the distribution roller, is sprayed off and recovered for recycling, the spraying agent being toner dispersion.

8 Claims, 3 Drawing Figures

APPARATUS FOR DEVELOPING A LATENT ELECTROSTATIC IMAGE ON AN ELECTROPHOTOGRAPHIC COPYING MATERIAL

BACKGROUND OF THE INVENTION

1. Field of the Invention

The present invention relates to a process for developing a latent electrostatic image on an electrophotographic copying material by means of a toner dispersion that is applied to the copying material at the beginning of the development process. The toner is precipitated according to the surface charge of the copying material, and, at the end of the development process, the unused toner dispersion is squeegeed off the copying material. The invention also relates to an apparatus for carrying out the foregoing process.

2. Description of the Prior Art

German Offenlegungsschriften Nos. 1,597,820 and 2,331,253 disclose development apparatus for electrophotographic copying materials in which the material provided with a charge image is guided through a development zone wherein a toner dispersion is applied to that surface of the copying material which carries the electrostatic charge image. The copying material passes through a pair of infeed rollers, the upper one of which is uniformly wetted with the toner dispersion. Thus the upper infeed roller applies a uniform film of toner dispersion to the copying material. At the end of the development zone there is a pair of squeegee rollers which squeegee the surplus toner dispersion off the surface of the copying material.

These development apparatus have the disadvantage that there is no steady toner supply at the upper infeed roller under all conditions and that the uniformity of toner application to larger areas is unsatisfactory. In order to obtain a more complete and more uniform development of the electrostatic charge image by the simplest means possible, an apparatus has been developed in which there is provided, above the web of copying material and between a pair of infeed rollers and a pair of squeegee rollers, a distribution roller that has a surface composed of soft and porous material and is grounded. Such apparatus is disclosed by German Utility Pat. No. 7,418,392. It has been found, however, that through use of such apparatus white lines in large black areas of the latent electrostatic charge image can only be insufficiently reproduced during development. In most cases the thin white lines in the black area are covered with toner, i.e., these lines either cannot be recognized at all or only insufficiently so that the contrasting effect of the powder image is imperfect. Another disadvantage is that the toner attracted by the surface of the distribution roller adheres to it and cannot be used for the further development process.

SUMMARY OF THE INVENTION

It is therefore the object of the invention to improve a process of the kind mentioned above and to provide an apparatus for carrying out the process so that the foregoing disadvantage of the toner covering the thin white lines in a black area of the electrostatic charge image is eliminated. By the same token, it is also an object of the invention to increase the contrasting effect of thin white lines. Finally, it is a related object of the invention to effect recovery, for further development, of the toner adhering to the distribution roller during development.

These objects are achieved by applying a voltage to the distribution roller for image forming precipitation of the toner during development, such voltage having the same sign, i.e., the same polarity, as the surface charge of the latent electrostatic image on the copying material.

If the latent charge image consists of negative charges, a negative voltage is applied to the distribution roller during the development process. Likewise, in the case of a positive charge image, a positive voltage is applied.

The voltage applied is at least as high as the level of surface charge in the image areas of a white area of the latent electrostatic image. It has to be taken into account, however, that the voltage applied must not be higher than the level of surface charge in the image areas of a black area of the latent electrostatic image.

The DC voltage is preferably applied as a counter voltage having a polarity opposite to the electrostatic charge of the toner contained in the dispersion, which toner is thus electrostatically attracted and may be recovered for reuse in the development process.

The value of the voltage to be applied thus depends on: (1) the level of charge of the latent image in the image areas of a black area of the electrostatic charge image, (2) the level of charge of the latent electrostatic charge image in the image areas of a white area, and (3) the thickness of the porous surface layer on the distribution roller. The levels of charge of the image areas of a black and white area of the electrostatic charge image thus represent the limits for the voltage to be applied. This voltage is usually in the range of from 1 to 600 volts, preferably between 20 and 350 volts.

The apparatus for carrying out the process is provided with a pair of infeed rollers for applying the toner dispersion to the copying material, a distribution roller for the toner dispersion, and a pair of squeegee rollers for removing the unused toner dispersion. There is a tray for collecting the unused toner dispersion and a system for directing the unused dispersion back to the pair of infeed rollers. According to the invention, the distribution roller has a surface which is composed of soft, porous and non-conductive material, which surface is in contact with the copying material as the copying material passes through the development zone. The distribution roller has a metal core which is connected to the first electrode of a controllable voltage source. A second electrode of the voltage source is preferably grounded and thus electrically connected to the electrically conductive carrier of the copying material.

The invention includes a device for spraying off the toner which adheres to the surface of the distribution roller because of the electrostatic attraction produced by the application of the DC voltage. The toner dispersion is used as a spraying agent and the device for spraying off the toner consists of a spray tube which is arranged above the distribution roller and which is provided with rows of openings arranged in the tube jacket. The openings are disposed symmetrically with respect to the perpendicular bisector of the spray tube. The second spray tube is preferably connected to a pump via a second pipe. From this pump a suction pipe leads to the tray for the excess toner dispersion, and the first pipe leads from the pump to a first spray tube above the upper infeed roller. The pump pumps toner dispersion from the tray through the suction pipe to the first and second spray tubes. The toner dispersion is applied to the distribution roller and to the upper infeed roller of the apparatus through these spray tubes.

To recapitulate, the process of the invention includes the step of applying the toner dispersion to the copying material having the latent electrostatic charge image thereon and the step of applying, to a distribution means above the copying material, a voltage having the same polarity as the surface charge of the latent electrostatic charge image on the copying material. According to more specific aspects, there is the step of removing unused toner dispersion from the copying material after the foregoing step of applying a voltage to the distribution means. The electrophotographic copying material carrying the electrostatic image has a first level of surface charge corresponding to a white area of the image and a second level of surface charge corresponding to a black area of the image. The voltage applied is at least as high as the first level of surface charge in the image areas of a white area of the latent electrostatic charge image. However, the voltage applied is not higher than the second level of surface charge in the image areas of a black area of the latent electrostatic image. The toner dispersion includes electrostatically charged toner and the voltage supply is a DC voltage having a polarity opposite to the electrostatic charge of the toner contained in the dispersion. The toner is thus electrostatically attracted to the distribution means and can be removed during development for reuse.

The apparatus of the invention includes: infeed means for applying the toner dispersion to the copying material; distribution means for the toner dispersion, the distribution means being disposed downstream of the infeed means in the direction of image development, the distribution means having a surface of soft, porous, and non-conductive material for contacting the carrying material, the soft surface covering a metal portion of the distribution means; a controllable voltage source having a first electrode electrically connected with the metal portion of the distribution means for applying a charge to the distribution means; and squeegee means for removing the unused toner dispersion from the copying material, the squeegee means being disposed downstream of the distribution means in the direction of image development. According to more specific aspects, return means, cooperating with the infeed means and with the squeegee means, returns unused toner dispersion from the squeegee means to the infeed means. Additionally, there is means cooperating with the distribution means for spraying off the toner adhering to the soft surface of the distribution means due to the electrostatic attraction during the application of the voltage. The return means includes: a tray disposed below the squeegee means for receiving excess toner dispersion; a suction pipe; a pump, the suction pipe effecting communication between the tray and the pump; a first spray tube disposed above the infeed means for supplying toner dispersion thereto; and a first pipe effecting communication between the spray tube and pump. The means for spraying off toner comprises a second spray tube arranged above the distribution means, the second spray tube having rows of openings arranged symmetrically with respect to a plane which is perpendicular to the surface of the distribution means and which bisects the second spray tube. The second spray tube is connected to the pump via a second pipe. The infeed means comprises a pair of infeed rollers; the distribution means comprises a distribution roller; and the squeegee means comprises a pair of squeegee rollers.

The invention will be described below in more detail, by way of example only, with reference to the accompanying drawings.

DETAILED DESCRIPTION OF THE PREFERRED EMBODIMENTS

Figure 1:
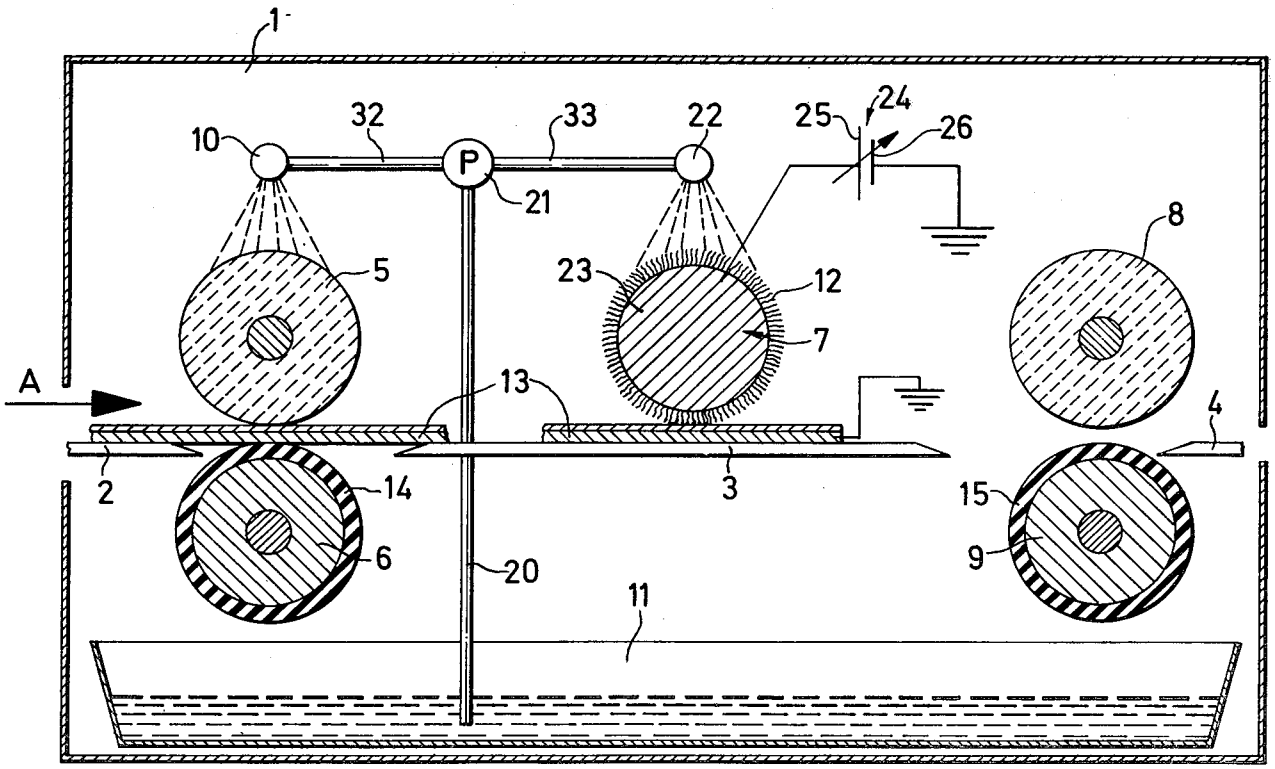
FIG. 1 is a schematic sectional view of an apparatus according to the invention.
Figure 3:
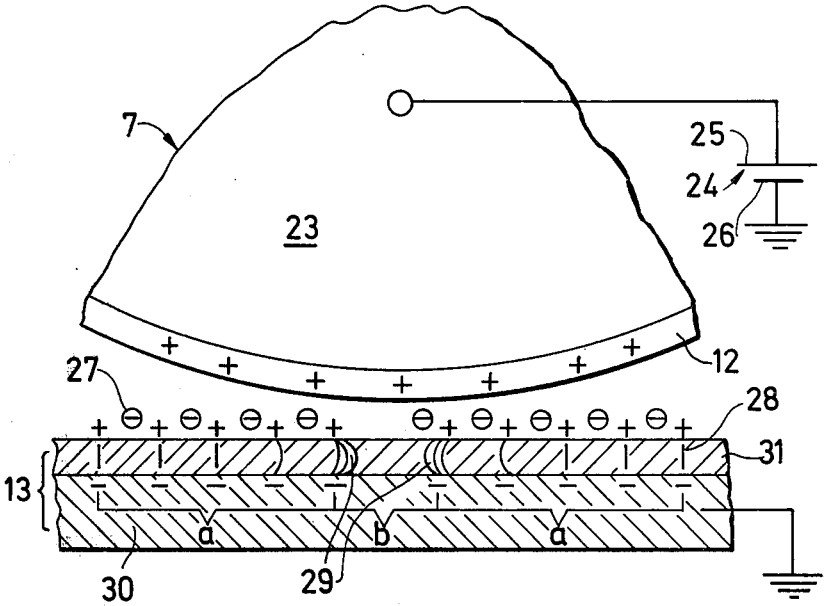
FIG. 3 is a schematic view of the charge distribution on the copying material and the distribution roller of the apparatus according to FIG. 1, as well as a view showing the electric field between the copying material and the distribution roller.

A development apparatus 1 for carrying out the process according to the invention is shown in FIG. 1. This development apparatus has at the beginning of the development zone an infeed plate 2 arranged in a horizontal position on which lies the copying material 13 to be developed, for example an electrophotographic printing plate. The copying material 13 consists of an electrically conductive carrier layer 30 and an electrophotographic recording layer 31 arranged thereon as shown in FIG. 3, which recording layer is uniformly electrostatically charged in a known manner by means of a corona charging device. Then the charged recording layer 31 is exposed to a light image, either in contact with an original item to be copied or episcopically or diascopically from an original. The latent electrostatic charge image thus obtained is developed by means of a toner dispersion in a development device 1, which dispersion preferably consists of toner particles dispersed in a liquid.

At the beginning and the end of the development device 1, infeed rollers 5,6 and squeegee rollers 8,9 are arranged, respectively. Between both sets of rollers and above a horizontally disposed guide plate 3, is a loosely supported distribution roller 7. Distribution roller 7 consists of a metal core 23 and a surface 12 composed of a soft, porous, and non-conductive material, e.g., Nylon velours or plush.

The copying material 13 to be developed is fed, together with the recording layer 31 carrying the electrostatic charge image, over the infeed plate 2 into the nip between the infeed rollers 5 and 6. The copying material 13 is then seized by these rollers and transported in the direction indicated by the arrow A through the development device 1.

FIG. 1 shows two printing plates, one of which is arranged in the vicinity of the distribution roller 7. The metal core 23 of the distribution roller 7 is connected to the first electrode 25 of a controllable voltage source 24, its second electrode 26 being connected to ground. The voltage source 24 is a DC voltage source and makes it possible to vary to a large extent the DC voltage applied to the metal core 23. As indicated in FIGS. 1 and 3, the electrically conductive carrier layer 30 of the copying material 13 is also connected to ground.

The upper infeed roller 5 is uniformly sprayed with the toner dispersion from the first spray tube 10. Thus a layer 19, composed, for example, of polyvinyl chloride (FIG. 2), on the surface of the upper infeed roller 5, is uniformly coated with a liquid film. The liquid film is transferred onto the recording layer 31 of the copying material 13, which layer 31 carries the charge image. As soon as the front edge of the copying material 13 reaches the distribution roller 7, this roller 7 starts revolving due to friction between the copying material 13 and the porous surface 12. Accordingly, the distribution roller 7 rolls over the entire surface of the copying material 13, thus distributing the toner dispersion uniformly onto all the image areas of the electrostatic charge image. Depending on the density of the electrostatic charge in the different image areas of the latent charge image, a larger or smaller amount of toner of the toner dispersion is electrostatically attracted to and precipitated onto the image areas. The copying material 13 is then passed on, seized by the squeegee rollers 8 and 9 and transported to the output plate 4. The nip between the squeegee rollers 8 and 9 is adjustable and is adjusted in such a manner that the excess toner dispersion or dispersing liquid is squeegeed off and the copying material thus leaves the development apparatus 1 in an almost dry state. The surface of the upper infeed roller 5 and the upper squeegee roller 8 preferably consist of ceramic material, while the lower infeed roller 6 and the lower squeegee roller 9 have flexible outer layers 14 and 15, respectively.

The excess toner dispersion flows into a tray 11 that extends over the entire development area between the infeed rollers 5 and 6 and the squeegee rollers 8 and 9. A suction pipe 20 is provided between the upper infeed roller 5 and the distribution roller 7. Suction pipe 20 is connected to a pump 21, and the open end of suction pipe 20 leads into the tray 11. From the pump 21 a first conveyor pipeline 32 leads to the first spray tube 10, and a second conveyor pipeline 33 leads to the second spray tube 22, the latter spray tube being arranged above the distribution roller 7. The second spray tube 22 renders possible the spraying off of toner 27 that adheres to the surface of the distribution roller 7 due to the particular electrostatic charging conditions during the application of the DC voltage.

Figure 2:
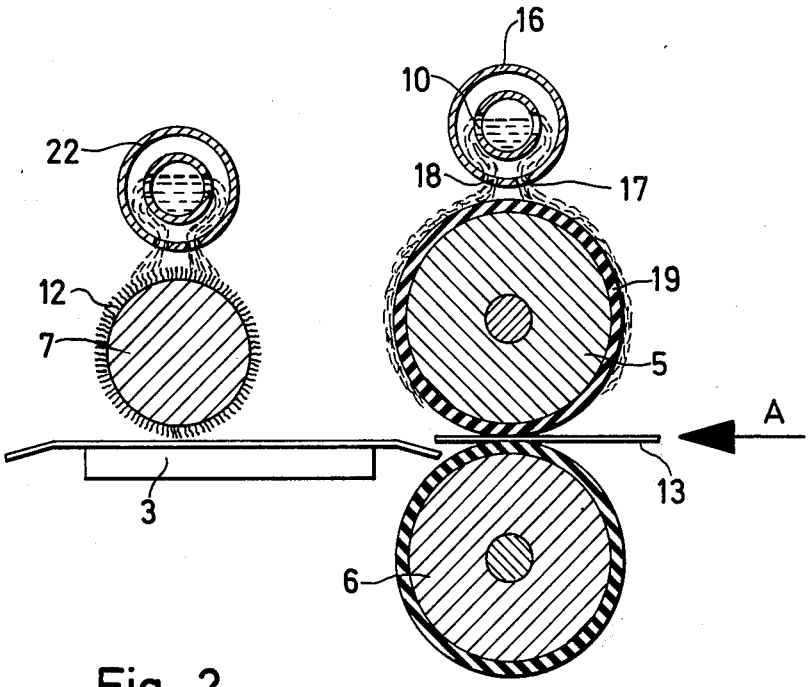
FIG. 2 is an enlarged view of a slightly modified portion of FIG. 1.

FIG. 2 shows a preferred embodiment of the two spray tubes 10 and 22. Each of the two spray tubes includes rows of openings 17, 18. These rows of openings are arranged in the jacket 16 symmetrically to the vertical, perpendicular bisector of each spray tube and at an angle of between 5° and 15° with respect thereto. This arrangement effects a particularly uniform distribution of the liquid film on the surfaces 12 and 19 of the distribution roller 7 and the upper infeed roller 5, respectively. In this embodiment the upper infeed roller 5 has, unlike the embodiment in FIG. 1, a flexible outer layer 19.

FIG. 3 shows an enlarged section of part of the copying material 13 and of the distribution roller 7. FIG. 3 serves to illustrate one possible effect which the DC voltage, applied to the distribution roller 7, has with respect to complete and unflawed development of thin white lines within larger black areas. The toner 27 has an electrostatic charge of negative polarity, and the charge distribution on the surface of the recording layer 31 is such that the unexposed image areas, i.e., the black areas, have a positive charge. The carrier layer 30 is grounded and has, accordingly, a negative charge on its upper surface. Between the two black areas *a* there is a thin white line *b*. The electrostatic field of the plate capacitor formed between the upper surface of the recording layer 31 and the upper surface of the carrier layer 30 is largely homogenous, as indicated by the straight lines of flux 28. Only in the marginal area between the black areas *a* and the thin white line *b* exist strong electric stray fields, represented by the bent lines of flux 29. An electrostatic force acts upon the toner 27 having a negative charge through these stray field lines, i.e., the bent lines of flux 29, so that the toner particles precipitate along these lines and thus in the range of the white area *b* of a thin white line. This leads to an undesirable covering of the white line with toner. In the case of wider white lines this does not matter since the size of the stray field is negligible as compared to the width of the white area.

If a DC voltage having the same polarity as the electrostatic charge image on the upper surface of the recording layer 31 is applied to the distribution roller 7 and is at least as high as the potential in the image areas of the white areas *b*, a zero field is produced in these areas or an inversion of the electric field is produced in the space between the surface of the recording layer 31 and the surface 12 of the distribution roller 7. Thus, the lack of homogeneity of the field in the transition area between the black areas *a* and the white area *b* is largely compensated or completely eliminated. Also, toner particles are attracted to the surface 12 of the distribution roller 7 because of the above-mentioned inversion of the electric field. During the development process the image areas of a thin white line thus remain free from toner and are distinctly visible after development.

The voltage applied can be between 1 and 600 volts, preferably between 20 and 350 volts. Of course voltages other than those given above may be applied, depending on the nature of the copying material and the level of the charging and discharging during exposure.

The level of charge in the image areas of the black areas *a* is in general several hundred volts, depending on the nature of the recording layer 31. In this case the toner 27 precipitates on the latent charge image in a somewhat lower density than in the case of a grounded distribution roller 7. This is due to the inversion which occurs by way of the DC voltage applied to the distribution roller 7, but the blackening obtained is completely sufficient. The decisive factor determining the density of the toner precipitation is the difference in voltage between the level of charging of the recording layer 31 in the image areas of black area *a* and the level of charging of the voltage applied to the distribution roller 7.

It is preferred to rinse off the toner 27, which is precipitated on the surface 12 of the distribution roller 7, by spraying it with the toner dispersion and collecting it in the tray 11 for reuse. As indicated above, the copying material 13 is covered with a homogeneous film of toner dispersion as it passes through infeed rollers 5,6. As indicated above, the toner in the film of toner dispersion is electrostatically precipitated from the homogeneous film of toner dispersion onto the image areas according to the latent charge image. Thus, the image is not affected by the spray from tube 22 during rinsing of the distribution roller 7 with toner dispersion. It will be understood that the copying material 13 may be located under the distribution roller 7 during rinsing as shown in FIG. 1.

We claim:

1. An apparatus for developing a latent electrostatic image on an electrophotographic copying material by means of a toner dispersion, the apparatus comprising:

a. infeed means for applying the toner dispersion to the copying material;

b. distribution means for the toner dispersion, said distribution means being disposed downstream of said infeed means in the direction of image development, said distribution means having a surface of soft, porous, and non-conductive material for contacting the copying material, said soft surface covering a metal portion of said distribution means;

c. a controllable voltage source having a first electrode electrically connected with said metal portion of said distribution means for applying a charge to said distribution means;

d. squeegee means for removing the unused toner dispersion from the copying material, said squeegee means being disposed downstream of said distribution means in the direction of image development; and e. means, cooperating with said distribution means, for spraying off the toner adhering to said soft surface of the distribution means due to electrostatic attraction during the application of the voltage.

2. An apparatus as defined in claim 1 wherein said voltage source includes a second electrode, said second electrode being grounded.

3. An apparatus as defined in claim 2 wherein said voltage source is a DC voltage source.

4. An apparatus as defined in claim 1 including return means, co-operating with said infeed means and with said squeegee means, for returning unused toner dispersion from said squeegee means to said infeed means.

5. An apparatus as defined in claim 4 wherein said return means includes: a tray disposed below said squeegee means for receiving excess toner dispersion; a suction pipe; a pump; said suction pipe effecting communication between said tray and said pump; a first spray tube disposed above said infeed means for supplying toner dispersion thereto; and a first pipe effecting communication between said first spray tube and said pump.

6. An apparatus as defined in claim 5 wherein said means for spraying off toner comprises a second spray tube arranged above said distribution means, said second spray tube having rows of openings arranged symmetrically with respect to a plane which is perpendicular to said surface of said distribution means and which bisects said second spray tube.

7. An apparatus as defined in claim 6 wherein said second spray tube is connected to said pump via a second pipe.

8. An apparatus as defined in claim 1 wherein said infeed means comprises a pair of infeed rollers, wherein said distribution means comprises a distribution roller, and wherein said squeegee means comprises a pair of squeegee rollers.

* * * * *